US007018017B2

(12) United States Patent
Song et al.

(10) Patent No.: US 7,018,017 B2
(45) Date of Patent: Mar. 28, 2006

(54) MONOLITHIC INK-JET PRINTHEAD HAVING A HEATER DISPOSED BETWEEN DUAL INK CHAMBERS AND METHOD FOR MANUFACTURING THE SAME

(75) Inventors: Hoon Song, Seoul (KR); Yong-soo Oh, Seongnam (KR); Jun-hyub Park, Seongnam (KR); Keon Kuk, Yongin (KR); Chang-seung Lee, Seongnam (KR); Young-jae Kim, Anyang (KR); Ji-hyuk Lim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 46 days.

(21) Appl. No.: 10/717,662

(22) Filed: Nov. 21, 2003

(65) Prior Publication Data

US 2004/0100535 A1 May 27, 2004

(30) Foreign Application Priority Data

Nov. 21, 2002 (KR) ..... 10-2002-0072697

(51) Int. Cl.
*B41J 2/05* (2006.01)
*B41J 2/14* (2006.01)
*B41J 2/16* (2006.01)

(52) U.S. Cl. ..... 347/56; 347/47; 347/65

(58) Field of Classification Search ..... 347/92–94, 347/67, 61–65, 56, 47, 44, 20
See application file for complete search history.

(56) References Cited

U.S. PATENT DOCUMENTS

| | | | | |
|---|---|---|---|---|
| 4,882,595 | A | 11/1989 | Trueba et al. | 347/92 |
| 4,894,664 | A * | 1/1990 | Tsung Pan | 347/63 |
| 6,000,787 | A | 12/1999 | Weber et al. | 347/65 |
| 6,019,457 | A * | 2/2000 | Silverbrook | 347/65 |
| 6,120,135 | A * | 9/2000 | Murthy et al. | 347/62 |
| 6,595,627 | B1 * | 7/2003 | Min et al. | 347/65 |
| 6,652,077 | B1 * | 11/2003 | Maeng et al. | 347/56 |
| 2002/0008738 | A1 | 1/2002 | Lee et al. | 347/62 |
| 2002/0167553 | A1 | 11/2002 | Nikkel | 347/1 |

* cited by examiner

*Primary Examiner*—Juanita D. Stephens
(74) *Attorney, Agent, or Firm*—Lee & Morse, P.C.

(57) ABSTRACT

A monolithic ink-jet printhead includes a substrate having a lower ink chamber formed on an upper surface thereof, a manifold for supplying ink to the lower ink chamber formed on a bottom surface thereof, and an ink channel providing communication therebetween; a nozzle plate having a plurality of passivation layers and a metal layer sequentially stacked on the substrate, the nozzle plate having an upper ink chamber formed therein on a bottom surface of the metal layer, a nozzle in communication with the upper ink chamber formed on an upper surface of the metal layer, and a connection hole providing communication between the upper ink chamber and the lower ink chamber; a heater located between the upper ink chamber and the lower ink chamber for heating ink contained in the lower and upper ink chambers; and a conductor electrically connected to the heater to apply a current to the heater.

24 Claims, 16 Drawing Sheets

MONOLITHIC INK-JET PRINTHEAD HAVING A HEATER DISPOSED BETWEEN DUAL INK CHAMBERS AND METHOD FOR MANUFACTURING THE SAME

BACKGROUND OF THE INVENTION

1. Field of the Invention

The present invention relates to an ink-jet printhead and a method for manufacturing the same. More particularly, the present invention relates to a thermally driven, monolithic, ink-jet printhead having a heater that is disposed between dual ink chambers, and a method for manufacturing the same.

2. Description of the Related Art

In general, an ink-jet printhead prints a predetermined image, color or black, by ejecting a small volume ink droplet of a printing ink at a desired position on a recording sheet. Ink-jet printheads are largely classified into two types depending on the ink droplet ejection mechanisms: a thermally driven ink-jet printhead, in which a heat source is employed to form and expand a bubble in ink thereby causing an ink droplet to be ejected, and a piezoelectrically driven ink-jet printhead, in which a piezoelectric crystal bends to exert pressure on ink, thereby causing an ink droplet to be expelled.

An ink droplet ejection mechanism of the thermally driven ink-jet printhead will now be described in detail. When a pulse current flows through a heater formed of a resistive heating material, heat is generated by the heater to rapidly heat ink near the heater to approximately 300° C. Accordingly, the ink boils and bubbles are formed in the ink. The formed bubbles expand and exert pressure on the ink contained within an ink chamber. This causes a droplet of ink to be ejected through a nozzle from the ink chamber.

The thermally driven ink-jet printhead may be further subdivided into top-shooting, side-shooting, and back-shooting types depending on the direction of ink droplet ejection and the direction in which a bubble expands. The top-shooting type refers to a mechanism in which an ink droplet is ejected in a direction that is the same as a direction in which a bubble expands. The back-shooting type is a mechanism in which an ink droplet is ejected in a direction opposite to the direction in which the bubble expands. In the side-shooting type, the direction of ink droplet ejection is perpendicular to the direction in which the bubble expands.

Thermally driven ink-jet printheads need to meet the following conditions. First, a simple manufacturing process, low manufacturing cost, and mass production must be provided. Second, to produce high quality color images, a distance between adjacent nozzles must be as small as possible while still preventing cross-talk between the adjacent nozzles. More specifically, to increase the number of dots per inch (DPI), many nozzles must be arranged within a small area. Third, for high-speed printing, a cycle beginning with ink ejection and ending with ink refill must be as short as possible. That is, the heated ink and heater should cool down quickly to increase an operating frequency. Fourth, heat load exerted on the printhead due to heat generated by the heater must be small, and the printhead must operate stably under a high operating frequency.

FIG. 1A illustrates a partial cross-sectional perspective view of a structure of a conventional thermally driven printhead. FIG. 1B illustrates a cross-sectional view of the printhead of FIG. 1A for explaining a conventional process of ejecting an ink droplet.

Referring to FIGS. 1A and 1B, a conventional thermally driven ink-jet printhead includes a substrate 10, a barrier wall 14 disposed on the substrate 10 for defining an ink chamber 26 filled with ink 29, a heater 12 disposed in the ink chamber 26, and a nozzle plate 18 having a nozzle 16 for ejecting an ink droplet 29'. If a pulse current is supplied to the heater 12, the heater 12 generates heat to form a bubble 28 in the ink 29 within the ink chamber 26. The formed bubble 28 expands to exert pressure on the ink 29 contained within the ink chamber 26, which causes an ink droplet 29' to be ejected through the nozzle 16. Then, the ink 29 flows from a manifold 22 through an ink channel 24 to refill the ink chamber 26.

The process of manufacturing a conventional top-shooting type ink-jet printhead configured as above involves separately manufacturing the nozzle plate 18 equipped with the nozzle 16 and the substrate 10 having the ink chamber 26 and the ink channel 24 formed thereon and bonding them together. The manufacturing process is complicated and misalignment may occur during the bonding of the nozzle plate 18 and the substrate 10. Furthermore, since the ink chamber 26, the ink channel 24, and the manifold 22 are arranged on the same plane, there is a restriction on increasing the number of nozzles 16 per unit area, i.e., the density of nozzles 16. This restriction makes it difficult to implement a high printing speed, high-resolution ink-jet printhead.

In particular, in the ink-jet printhead having the above-described structure, since the heater 12 contacts an upper surface of the substrate 10, approximately 50% of heat energy generated from the heater 12 is conducted into and absorbed by the substrate 10. Although the heat energy generated from the heater 12 is intended for use in boiling the ink 19 to generate the bubble 28, a significant portion of the heat energy is absorbed into the substrate 10 and only a small portion of the heat energy is actually used in forming the bubble 28. More specifically, the heat energy supplied for the purpose of generating the bubble 28 is consumed, lowering energy efficiency. In addition, the heat energy conducted to other parts of the printhead considerably increases the temperature of the printhead as the print cycles are repeated. Accordingly, since a boiling time and a cooling time of the ink 29 are increased, it is difficult to implement a high operating frequency. Further, several thermal problems may occur in the printhead, making the printhead difficult operate in a stable manner for an extended period of time.

Recently, in an effort to overcome the above problems of the conventional ink-jet printheads, ink-jet printheads having a variety of structures have been proposed. FIG. 2 illustrates an example of a conventional monolithic ink-jet printhead.

Referring to FIG. 2, a hemispherical ink chamber 32 and a manifold 36 are formed on a front surface and a rear surface of a silicon substrate 30, respectively. An ink channel 34 is formed at a bottom of the ink chamber 32 and provides communication between the ink chamber 32 and the manifold 36. A nozzle plate 40, including a plurality of passivation layers 41, 42, and 43 stacked on the substrate 30, is formed integrally with the substrate 30.

The nozzle plate 40 has a nozzle 47 formed at a location corresponding to a central portion of the ink chamber 32. A heater 45 connected to a conductor 46 is disposed around the nozzle 47. A nozzle guide 44 extends along an edge of the nozzle 47 toward a depth direction of the ink chamber 32. Heat generated by the heater 45 is transferred through an insulating layer 41 to ink 48 within the ink chamber 32. The ink 48 then boils to form bubbles 49. The formed bubbles 49 expand to exert pressure on the ink 48 contained within the ink chamber 32, thereby causing an ink droplet 48' to be ejected through the nozzle 47. Then, the ink 48 flows through the ink channel 34 from the manifold 36 due to surface tension of the ink 48 contacting the air to refill the ink chamber 32.

A conventional monolithic ink-jet printhead configured as above has an advantage in that the silicon substrate 30 is formed integrally with the nozzle plate 40 thereby simplifying the manufacturing process and eliminating the chance of misalignment. Another advantage is that the nozzle 46, the ink chamber 32, the ink channel 34, and the manifold 36 are arranged vertically to increase the density of nozzles 46, as compared with the conventional ink-jet printhead shown in FIG. 1A.

In the conventional monolithic ink-jet printhead shown in FIG. 2, however, since the heater is provided over the ink chamber 32, heat dissipating from the heater 45 upward is initially absorbed in the passivation layers 42 and 43 surrounding the heater 45 while heat dissipating from the heater 45 downward is secondarily conducted into the substrate 30 through the passivation layer 41 and used to generate the bubble 49 by boiling the ink 48 contained in the ink chamber 32.

As described above, there still exist problems of reduced energy efficiency and elevated temperature of the printhead according to repeated printing cycles, complicating implementation of a sufficiently high operating frequency and making it difficult for the printhead to operate in a stable manner for an extended period of time.

SUMMARY OF THE INVENTION

It is a feature of an embodiment of the present invention to provide a monolithic ink-jet printhead in which a heater is disposed between dual ink chambers so that a majority of heat energy generated from the heater can be transferred to ink, thereby increasing energy efficiency and operating frequency, and allowing the printhead to operate in a stable manner for an extended period of time.

It is another feature of an embodiment of the present invention to provide a method for manufacturing the monolithic ink-jet printhead.

According to a feature of the present invention, there is provided a monolithic ink-jet printhead including a substrate having a lower ink chamber to be supplied with ink formed on an upper surface thereof, a manifold for supplying ink to the lower ink chamber formed on a bottom surface thereof, and an ink channel, which perpendicularly penetrates the substrate for providing communication between the lower ink chamber and the manifold; a nozzle plate having a plurality of passivation layers stacked on the substrate and a metal layer stacked on the passivation layers, the nozzle plate having an upper ink chamber formed therein on a bottom surface of the metal layer, and a nozzle in communication with the upper ink chamber formed on an upper surface of the metal layer; a heater provided between adjacent passivation layers of the plurality of passivation layers, the heater being located between the upper ink chamber and the lower ink chamber for heating ink contained in the lower and upper ink chambers; a connection hole providing communication between the upper ink chamber and the lower ink chamber; and a conductor provided between adjacent passivation layers of the plurality of passivation layers, the conductor being electrically connected to the heater to apply a current to the heater.

Preferably, the upper ink chamber has a diameter the same as or smaller than a diameter of the lower ink chamber. Preferably, the connection hole is formed at a location corresponding to a center of the upper ink chamber and has a circular, oval or polygonal shape. Also preferably, the heater surrounds the connection hole.

The connection hole may include a plurality of connection holes formed adjacent an edge of the upper ink chamber. In that case, the heater has a rectangular shape. The plurality of connection holes may be formed around the heater and spaced apart a predetermined distance from the heater.

At least a portion of each of the plurality of connection holes may be disposed within the boundary of the heater, and the heater may define a plurality of apertures, each of the plurality of apertures exposing one of the plurality of connection holes. Each of the plurality of apertures may either be a hole surrounding an entire one of the plurality of connection holes or a groove surrounding a portion of one of the plurality of connection holes.

The lower ink chamber may include a plurality of hemispherical cavities in communication in a circumferential direction below a respective one of the plurality of connection holes. The ink channel may be formed at a central portion of a bottom of each of the plurality of hemispherical cavities.

The ink channel may include a single ink channel formed at a location corresponding to a center of the lower ink chamber. Alternately, the ink channel comprises a plurality of ink channels formed on a bottom surface of the lower ink chamber.

The nozzle may have a tapered shape in which a cross-sectional area decreases gradually toward an exit.

The metal layer is made of one selected from the group consisting of nickel, copper and gold and be formed by electroplating to a thickness of about 30–100 μm.

According to another feature of the present invention, there is provided a method for manufacturing a monolithic ink-jet printhead including (a) preparing a substrate; (b) stacking a plurality of passivation layers on the substrate and forming a heater and a conductor connected to the heater between adjacent passivation layers of the plurality of passiviation layers; (c) forming a connection hole by etching to penetrate the plurality of passivation layers; (d) forming a metal layer on the plurality of passivation layers and forming an upper ink chamber in communication with the connection hole on a bottom surface of the metal layer so as to be disposed above the heater, and forming a nozzle on an upper surface of the metal layer in communication with the upper ink chamber; (e) forming a lower ink chamber in communication with the connection hole so as to be disposed under the heater by etching an upper surface of the substrate through the connection hole; (f) forming a manifold for supplying ink by etching a bottom surface of the substrate; and (g) forming an ink channel by etching the substrate between the manifold and the lower ink chamber to penetrate the substrate.

The substrate is preferably made of a silicon wafer.

Forming the heater and the conductor connected to the heater while sequentially stacking the plurality of passivation layers on the substrate may include forming a first passivation layer on an upper surface of the substrate; forming the heater by depositing a resistive heating material on an entire surface of the first passivation layer and patterning the same; forming a second passivation layer on the first passivation layer and the heater; forming a contact hole exposing a portion of the heater by partially etching the second passivation layer; forming the conductor connected to the heater through the contact hole by depositing a metal having electrical conductivity on the second passivation layer and patterning the same; and forming a third passivation layer on the second passivation layer and the conductor.

The connection hole may be formed by anisotropically dry-etching the plurality of passivation layers using reactive ion etching.

Forming the metal layer on the plurality of passivation layers and forming the upper ink chamber in communication with the connection hole on the bottom surface of the metal layer so as to be disposed above the heater, and forming the nozzle on the upper surface of the metal layer in communication with the upper ink chamber may include forming a seed layer for electroplating on the passivation layers; forming a sacrificial layer for forming the upper ink chamber and the nozzle on the seed layer; forming the metal layer on the seed layer by electroplating; and forming the upper ink chamber and the nozzle by removing the sacrificial layer and the seed layer formed under the sacrificial layer.

The seed layer may be formed by depositing at least one of copper, chromium, titanium, gold and nickel on the passivation layers.

Forming the sacrificial layer may include coating photoresist on the seed layer to a predetermined thickness; forming the sacrificial layer shaped of the nozzle by initially patterning an upper portion of the photoresist; and forming the sacrificial layer shaped of the upper ink chamber under the nozzle-shaped sacrificial layer by subsequently patterning a lower portion of the photoresist. The initial patterning may be performed on the nozzle-shaped sacrificial layer by a proximity exposure process for exposing the photoresist PR using a photomask which is separated from an upper surface of the photoresist by a predetermined distance, in a tapered shape in which a cross-sectional area of the sacrificial layer increases gradually downward. An inclination of the nozzle-shaped sacrificial layer may be adjusted by varying a distance between the photomask and the photoresist and by varying an exposure energy.

The metal layer is made of a material selected from the group consisting of nickel, copper and gold.

The method may further include planarizing an upper surface of the metal layer by chemical mechanical polishing, after forming the metal layer.

Forming the lower ink chamber may include isotropically dry-etching the substrate exposed through the connection hole. Forming the ink channel may include anisotropically dry-etching the substrate from a bottom surface of the substrate having the manifold. Forming the ink channel may include anisotropically dry-etching an upper surface of the substrate on a bottom of the lower ink chamber through the connection hole.

The connection hole may include a single connection hole formed at a location corresponding to a center of the upper ink chamber, wherein the heater surrounds the connection hole.

The connection hole may include a plurality of connection holes formed adjacent an edge of the ink chamber, wherein the heater has a rectangular shape. The plurality of connection holes may be formed around the heater and spaced apart a predetermined distance from the heater.

The heater may be patterned to define a plurality of apertures, each of the plurality of apertures exposes one of the plurality of connection holes formed within or across the boundary of the heater. Each of the plurality of apertures may either be a hole surrounding an entire one of the plurality of connection holes or a groove surrounding a portion of one of the plurality of connection holes.

Forming the lower ink chamber may include providing communication between a plurality of hemispherical cavities in a circumferential direction below the plurality of connection holes. The ink channel may include a single ink channel formed at a central portion of the ink chamber and the plurality of hemispherical cavities are in communication in a radial direction due to the ink channel. The ink channel is formed at a central portion of a bottom of each of the plurality of hemispherical cavities.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1A:
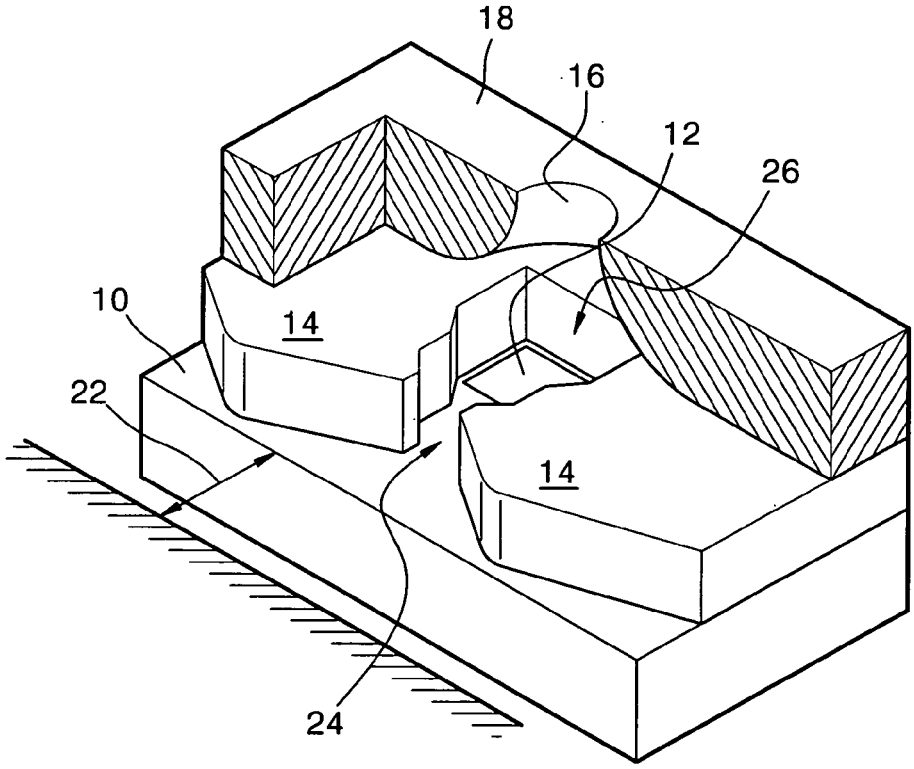
FIG. 1A (PRIOR ART)
FIGS. 1A and 1B illustrate a partial cross-sectional perspective view of a conventional thermally driven ink-jet printhead and a cross-sectional view for explaining a conventional process of ejecting an ink droplet, respectively.
Figure 1B:
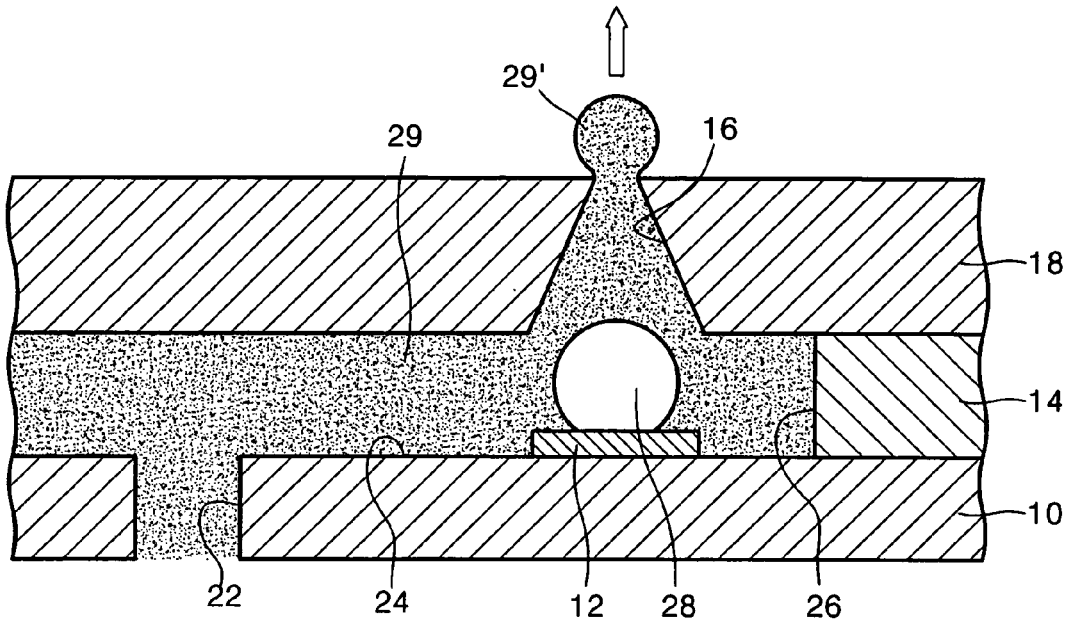
FIG. 1B (PRIOR ART)
Figure 2:
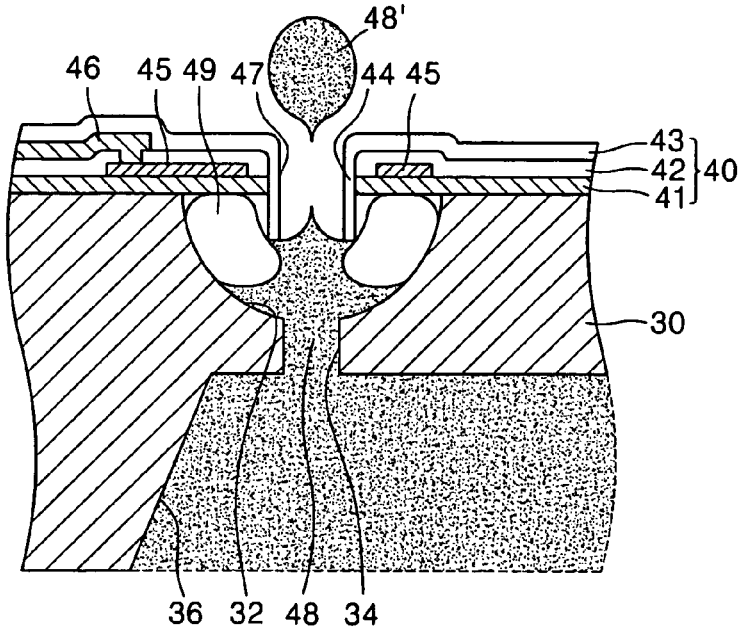
FIG. 2 (PRIOR ART)
FIG. 2 illustrates a vertical cross-sectional view of an example of a conventional monolithic ink-jet printhead.

Korean Patent Application No. 2002-72697, filed on Nov. 21, 2002, and entitled: "Monolithic Ink-Jet Printhead Having a Heater Disposed Between Dual Ink Chambers and Manufacturing Method Thereof," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the thickness of layers and regions and the sizes of components may be exaggerated for clarity. It will also be understood that when a layer is referred to as being "on" another layer or substrate, it can be directly on the other layer or substrate, or intervening layers may also be present. Like reference numerals refer to like elements throughout.

Figure 3A:
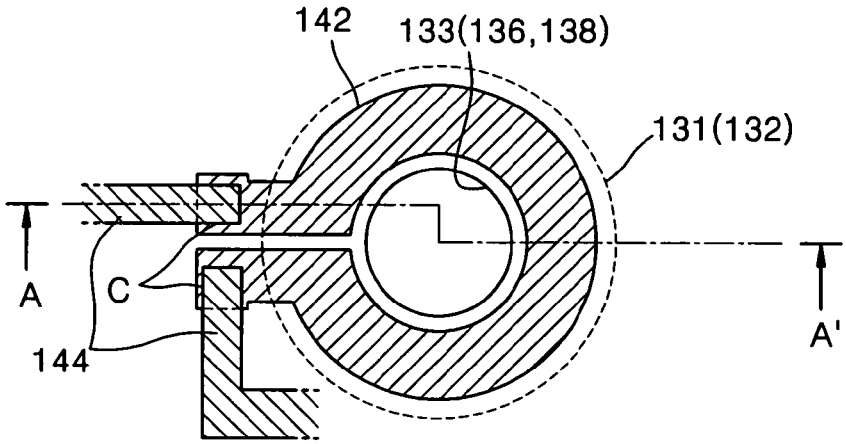
FIG. 3A illustrates a planar structure of a monolithic ink-jet printhead according to a preferred embodiment of the present invention.
Figure 3B:
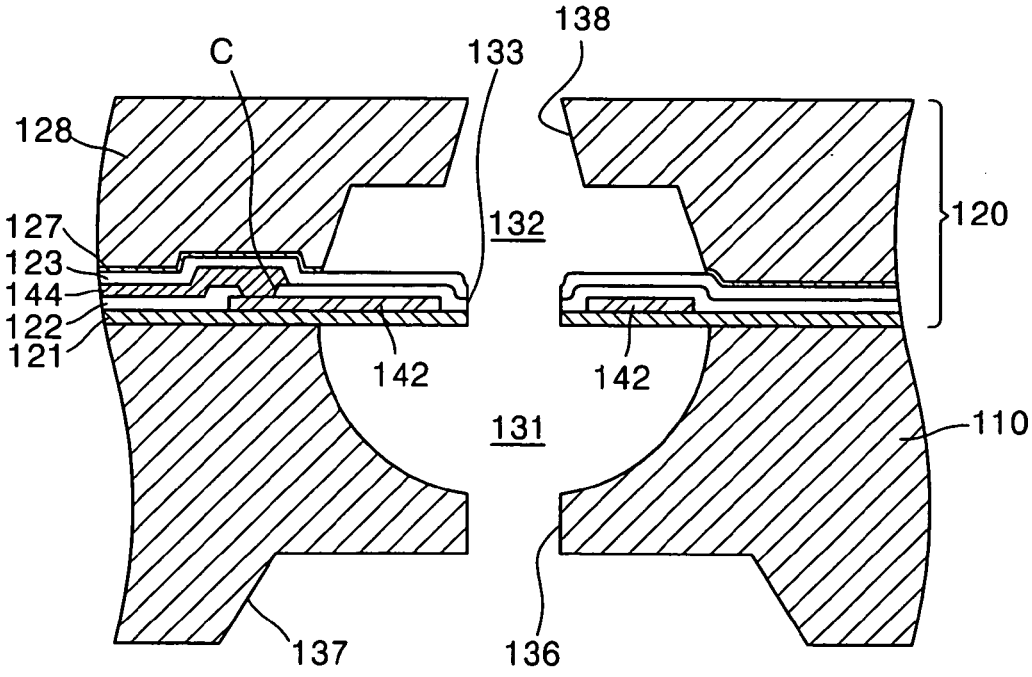
FIG. 3B illustrates a vertical cross-sectional view of the ink-jet printhead of the present invention taken along line A–A' of FIG. 3A.

FIG. 3A illustrates a planar structure of a monolithic ink-jet printhead according to a preferred embodiment of the present invention. FIG. 3B illustrates a vertical cross-sectional view of the ink-jet printhead of the preferred embodiment of the present invention taken along line A–A' of FIG. 3A. Although only a unit structure of the ink-jet printhead has been shown in the drawings, the shown unit structure may be arranged in one or two rows, or in three or more rows to achieve a higher resolution in an ink-jet printhead manufactured in a chip state.

Referring to FIGS. 3A and 3B, a lower ink chamber 131 to be supplied with ink to be ejected is formed on an upper surface of a substrate 110 to a predetermined depth. A manifold 137 for supplying ink to the lower ink chamber 131 is formed on a bottom surface of the substrate 110. The lower ink chamber 131 may be formed in a hemispherical shape or another shape according to the forming method, which will later be described. The manifold 137 is positioned under the lower ink chamber 131 and is in communication with an ink reservoir (not shown) for storing ink. An ink channel 136 provides communication between the lower ink chamber 131 and the manifold 137. The ink channel 136 is formed between the lower ink chamber 131 and the manifold 137 and perpendicularly penetrates the substrate 110. The ink channel 136 may be formed in a central portion of a bottom surface of the lower ink chamber 131, and a horizontal cross-sectional shape is preferably circular. Alternately, the ink channel 136 may have various horizontal cross-sectional shapes, such as an oval or polygonal shape. Further, the ink channel 136 may be formed at any other location that can provide communication between the lower ink chamber 131 and the manifold 137 by perpendicularly penetrating the substrate 110.

A nozzle plate 120 is formed on an upper surface of the substrate 110 having the lower ink chamber 131, the ink channel 136, and the manifold 137 formed thereon. The nozzle plate 120 includes a plurality of passivation layers stacked on the substrate 110. The plurality of passivation layers include first, second, and third passivation layers 121, 122, and 123, a metal layer 128 stacked on the third passivation layer 123 by electroplating. A heater 142 is provided between the first and second passivation layers 121 and 122, and a conductor 144 is provided between the second and third passivation layers 122 and 123. An upper ink chamber 132 is formed on a bottom surface of the metal layer 128, and a nozzle 138, through which ink is ejected, is formed on the upper ink chamber 132 to perpendicularly penetrate the metal layer 128.

The first passivation layer 121, the lowermost layer among the plurality of passivation layers forming the nozzle plate 120, is formed on the upper surface of the substrate 110. The first passivation layer 121 provides electrical insulation between the overlying heater 142 and the underlying substrate 110 and protection of the heater 142. The first passivation layer 121 may be made of silicon oxide or silicon nitride.

The heater 142 overlying the first passivation layer 121 and located between the lower ink chamber 131 and the upper ink chamber 132 for heating ink contained in the lower and upper ink chambers 131 and 132 is formed such that it surrounds a connection hole 133, which will be described later. The heater 142 consists of a resistive heating material, such as polysilicon doped with impurities, tantalum-aluminum alloy, tantalum nitride, titanium nitride, and tungsten silicide. The heater 142 may have a shape of a circular ring surrounding the connection hole 133, as shown in the drawing, or another shape, such as a rectangle or a hexagon.

A second passivation layer 122 for protecting the heater 142 is formed on the first passivation layer 121 and the heater 142. Similarly to the first passivation layer 121, the second passivation layer 122 may be made of silicon nitride or silicon oxide.

The conductor 144 electrically connected to the heater 142 for applying a pulse current to the heater 142 is formed on the second passivation layer 122. A first end of the conductor 144 is connected to the heater 142 through a contact hole C formed in the second passivation layer 122, and a second end of the conductor 144 is electrically connected to a bonding pad (not shown). The conductor 144 may be made of a highly conductive metal, such as aluminum, aluminum alloy, gold, or silver.

The third passivation layer 123 is provided on the conductor 144 and the second passivation layer 122 for providing electrical insulation between the overlying metal layer 128 and the underlying conductor 144 and protection of the conductor 144. The third passivation layer 123 may be made of tetraethylorthosilicate (TEOS) oxide or silicon oxide.

The metal layer 128 is made of a metal having a high thermal conductivity, such as nickel or copper. The metal layer 128 functions to dissipate the heat from the heater 142. That is, the heat residing in or around the heater 142 after ink ejection is transferred to the substrate 110 and the metal layer 128 via the heat conductive layer 124 and then dissipated. The metal layer 128 is formed by electroplating the metal on the third passivation layer 123 relatively thickly, that is, as thickly as about 30–100 μm, preferably, 45 μm or more. To form the metal layer, a seed layer 127 for electroplating of the metal is provided on the third passivation layer 123. The seed layer 127 may be made of a metal having good electric conductivity and etching selectivity between the metal layer 128 and the seed layer 127, for example, titanium (Ti) or copper (Cu).

As described above, the upper ink chamber 132 and the nozzle 138 are formed on the metal layer 128. The upper ink chamber 132 faces the lower ink chamber 131 formed on the substrate 110 with the passivation layers 121, 122 and 123 disposed therebetween. Thus, the passivation layers 121, 122 and 123 disposed between the lower ink chamber 131 and the upper ink chamber 132, form both an upper wall of the lower ink chamber 131 and a bottom wall of the upper ink chamber 132. The heater 142 is positioned between the lower ink chamber 131 and the upper ink chamber 132. Thus, a majority of the heat energy generated from the heater 142 is transferred to ink filling the lower ink chamber 131 and the upper ink chamber 132. Further, a connection hole 133 providing communication between the lower ink chamber 131 and the upper ink chamber 132 is formed at a location corresponding to a center of the lower ink chamber 131 and perpendicularly penetrates the passivation layers 121, 122 and 123. The connection hole 133 may have various planar shapes, such as a circular, oval or polygonal shape.

The planar structure of the upper ink chamber 132 may be of a circular or other shape according to the shape of the lower ink chamber 131. In addition, the upper ink chamber 132 may have a diameter the same as or smaller than that of the lower ink chamber 131.

While the nozzle 138 has a cylindrical shape, it is preferable that it has a tapered shape, in which a cross-sectional area decreases gradually toward an exit, as shown in FIG. 3B. In a case where the nozzle 138 has the tapered shape as described above, the meniscus in the ink surface after ink ejection is more quickly stabilized. Further, the horizontal cross-sectional shape of the nozzle 138 is preferably circular. However, the nozzle 138 may have various cross-sectional shapes, such as an oval or polygonal shape.

Figure 4A:
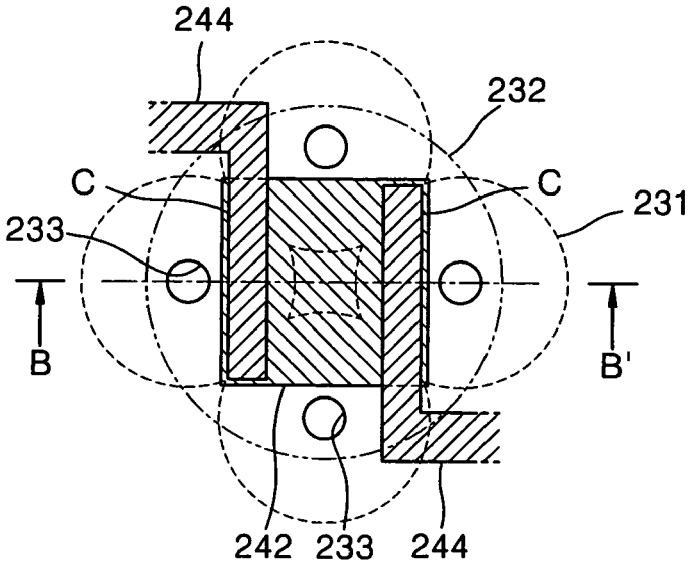
FIG. 4A illustrates a planar structure of a monolithic ink-jet printhead according to a second embodiment of the present invention.
Figure 4B:
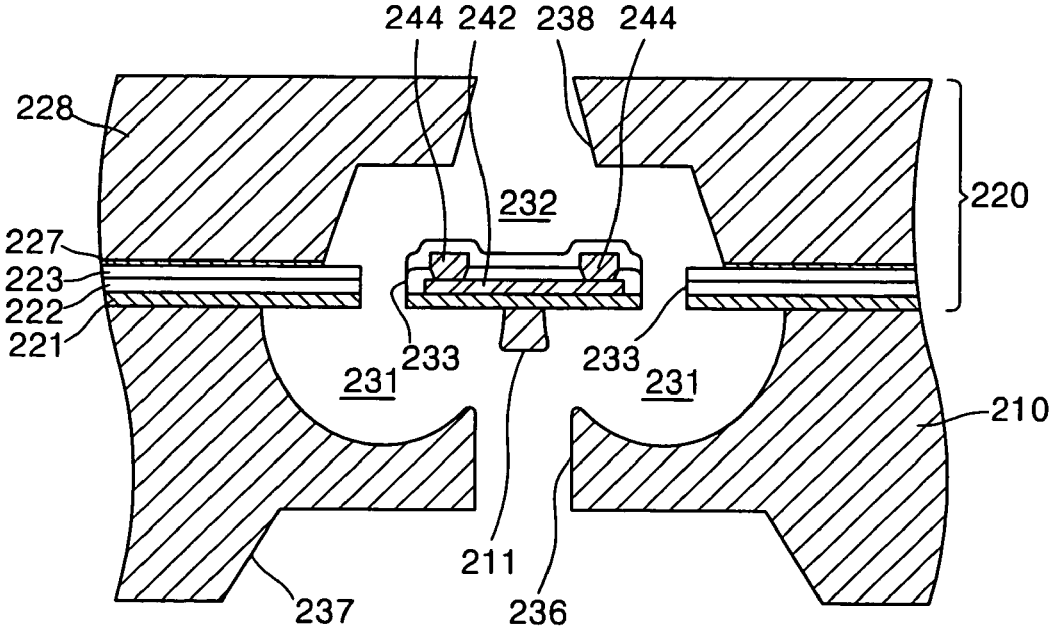
FIG. 4B illustrates a vertical cross-sectional view of the ink-jet printhead of the present invention taken along line B–B' of FIG. 4A.

FIG. 4A illustrates a planar structure of a monolithic ink-jet printhead according to a second embodiment of the present invention. FIG. 4B illustrates a vertical cross-sectional view of the ink-jet printhead of the second embodiment of the present invention taken along line B–B' of FIG. 4A. Hereinbelow, an explanation of the same elements as those in the preferred embodiment will be omitted or will be mentioned only briefly.

Referring to FIGS. 4A and 4B, the ink-jet printhead according to a second embodiment of the present invention includes a substrate 210 and a nozzle plate 220 having a plurality of passivation layers stacked on the substrate 210. A lower ink chamber 231 is formed on the upper surface of a substrate 210 to a predetermined depth. A manifold 237 is formed on the bottom surface of the substrate 210. An ink channel 236 is formed between the lower ink chamber 231 and the manifold 237.

The nozzle plate 220 includes first, second, and third passivation layers 221, 222, and 223 sequentially stacked on the substrate 210, and a metal layer 228 stacked on the third passivation layer 223 by electroplating. The first, second, and third passivation layers 221, 222, and 223, the metal layer 228 and a seed layer 227 formed for electroplating of the metal layer 228, are the same as those described in connection with the preferred embodiment of the present invention and a detailed explanation thereof will be omitted.

An upper ink chamber 232 is formed on the bottom surface of the metal layer 228. A nozzle 238, through which ink is ejected, is formed on the upper ink chamber 232 to perpendicularly penetrate the metal layer 228. The upper ink chamber 232 and the nozzle 238 are the same as those described in connection with the preferred embodiment of the present invention.

A heater 242 is located between the first passivation layer 221 and the second passivation layer 222, and a conductor 244 is disposed between the second passivation layer 222 and the third passivation layer 223. According to the second embodiment, the heater 242 is disposed between the lower ink chamber 231 and the upper ink chamber 232 in a rectangular shape. The conductor 244 is connected to both ends of the heater 242 through a contact hole C.

A plurality of connection holes 233 providing communication between the lower ink chamber 231 and the upper ink chamber 232 are provided around the rectangular heater 242 and penetrate the passivation layers 221, 222 and 223. As shown in FIG. 4A, four connection holes 233 may be provided adjacent an edge of the upper ink chamber 232 at a constant angular interval. The lower ink chamber 231 is formed by isotropically etching the substrate 210 through the connection holes 233. More specifically, if the substrate 210 is isotropically etched through the connection holes 233, hemispherical cavities are formed below the respective connection holes 233, and the cavities are in communication in a circumferential direction, forming the lower ink chamber 231. In this case, an unetched substrate material 211 may remain under the central portion of the heater 242. If desired, the unetched substrate material 211 may be removed by reducing a spacing between each of the respective connection holes 233 or by increasing an etching depth. Accordingly, the hemispherical cavities can be in communication in a radial direction as well as in the circumferential direction. The hemispherical cavities can also be in communication in a radial direction through the ink channel 236 by forming the ink channel 236 at the central portion of the lower ink chamber 231.

Figure 5A:
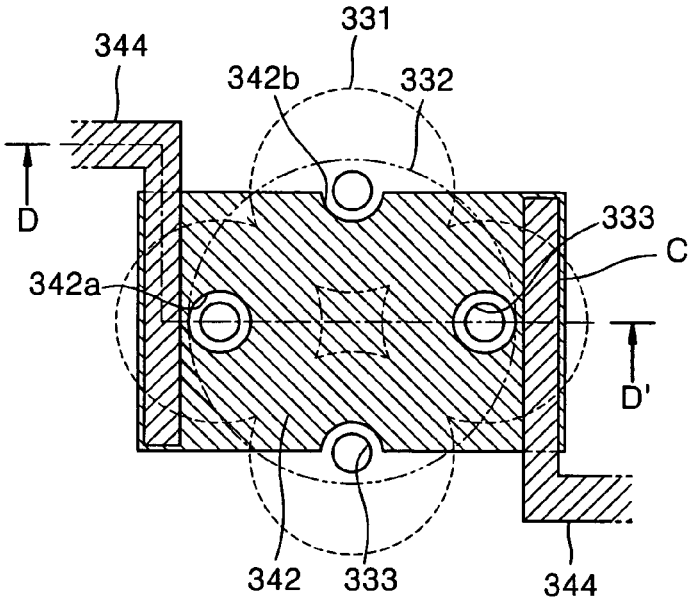
FIG. 5A illustrates a planar structure of a monolithic ink-jet printhead according to a third embodiment of the present invention.
Figure 5B:
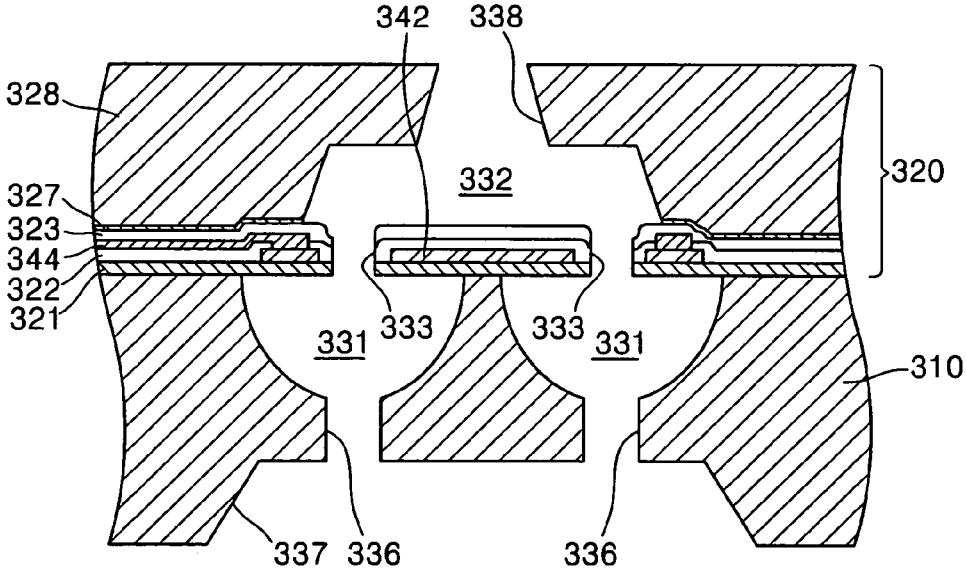
FIG. 5B illustrates a vertical cross-sectional view of the ink-jet printhead of the present invention taken along line D-D' of FIG. 5A.

FIG. 5A illustrates a planar structure of a monolithic ink-jet printhead according to a third embodiment of the present invention. FIG. 5B illustrates a vertical cross-sectional view of the ink-jet printhead of the third embodiment of the present invention taken along line D–D' of FIG. 5A. Hereinbelow, an explanation of the same elements as those in the above-described embodiment will be omitted or will be mentioned only briefly.

As shown in FIGS. 5A and 5B, the structure of the ink-jet printhead according to the third embodiment of the present invention is similar to that in the second embodiment, except that a wider rectangular heater 342 is provided for increasing heat emission and an ink channel 336 includes a plurality of ink channels.

If an area of the heater 342 is increased as described above, a connection hole 333 is located within or across the boundary of the heater 342 so that it may partially overlie the heater 342. In detail, the connection hole 333 includes a plurality of connection holes spaced apart at an equal angular interval adjacent to the peripheral portion of the upper ink chamber 332. The heater 342 has apertures, such as a hole 342*a* and a groove 342*b*, which surround at least a portion of each of the plurality of connection holes 333, to expose the plurality of connection holes 333. The heater 342 is formed between the first and second passivation layers 321 and 322, and is arranged between the lower ink chamber 331 formed on the upper surface of the substrate 310 and the upper ink chamber 332 formed on the bottom surface of the metal layer 328. A conductor 344 connected to opposite ends of the heater 342 through a contact hole C is provided between the second and third passivation layers 322 and 323.

A nozzle plate 320 provided on the substrate 310 includes the passivation layers 321, 322 and 323 and a metal layer 328. The upper ink chamber 332 and a tapered nozzle 338 are formed in the metal layer 328. Reference numeral 327 denotes a seed layer for electroplating of the metal layer 328.

The lower ink chamber 331 formed on the upper surface of the substrate 310 can be formed by isotropically etching the substrate 310 through the connection holes 333 as in the second embodiment. In addition, the ink channel 336 connecting the lower ink chamber 331 and a manifold 337 may include a plurality of ink channels. Each of the ink channels 336 is formed for each hemispherical cavity forming the lower ink chamber 331.

Alternatively, only a single ink channel 336 may be formed at the central portion of the lower ink chamber 331 as in the second embodiment. Further, in a modification of the second embodiment, a plurality of ink channels may be formed like in the third embodiment. The formation of the plurality of ink channels is similarly applicable to the preferred embodiment.

As described above, in the ink-jet printheads according to the preferred, second and third embodiments of the present invention, since a heater is disposed between dual ink chambers, a majority of heat energy generated from the heater can be transferred to ink filling the dual ink chambers, thereby increasing energy efficiency. In addition, according to the present invention, the heat energy conducted to a substrate is considerably reduced as compared to a conventional structure and an increase in the temperature of the printhead can be suppressed. Further, since heat residing in or around the heater after ink ejection is dissipated through a metal layer, an increase in the temperature of the printhead can be more effectively suppressed. Accordingly, since boiling and cooling of ink are promoted, it is possible to increase the operating frequency, allowing the printhead to operate in a stable manner for an extended period of time.

An ink ejection mechanism for the ink-jet printhead according to the second embodiment of the present invention, shown in FIG. 4B, will now be described with reference to FIGS. 6A through 6C.

Figure 6A:
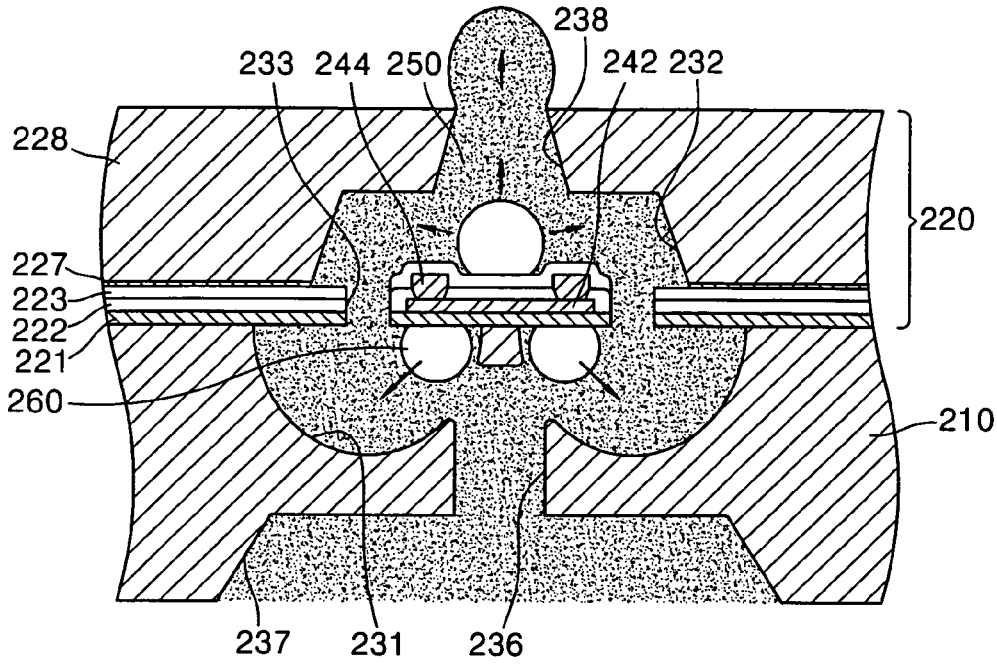
FIGS. 6A through 6C illustrate an ink ejection mechanism in a monolithic ink-jet printhead according to the second embodiment of the present invention shown in FIGS. 4A and 4B.

Referring to FIG. 6A, if a pulse current is applied to the heater 242 through the conductor 244 when the lower and upper ink chambers 231 and 232 and the nozzle 238 are filled with ink 250, heat is generated by the heater 242. The generated heat is transferred through the passivation layers 221, 222 and 223 overlying and underlying the heater 242 to the ink 250 within the lower and upper ink chambers 231 and 232 so that the ink 250 boils to form bubbles 260 both below and above the heater 242. Since a majority of the heat energy generated from the heater 242 is transferred to the ink 250, the ink 250 is boiled quickly and the bubbles 260 are rapidly formed. As the formed bubbles 260 expand upon a continuous supply of heat, the ink 250 within the nozzle 238 is ejected out of the nozzle 238.

Figure 6B:
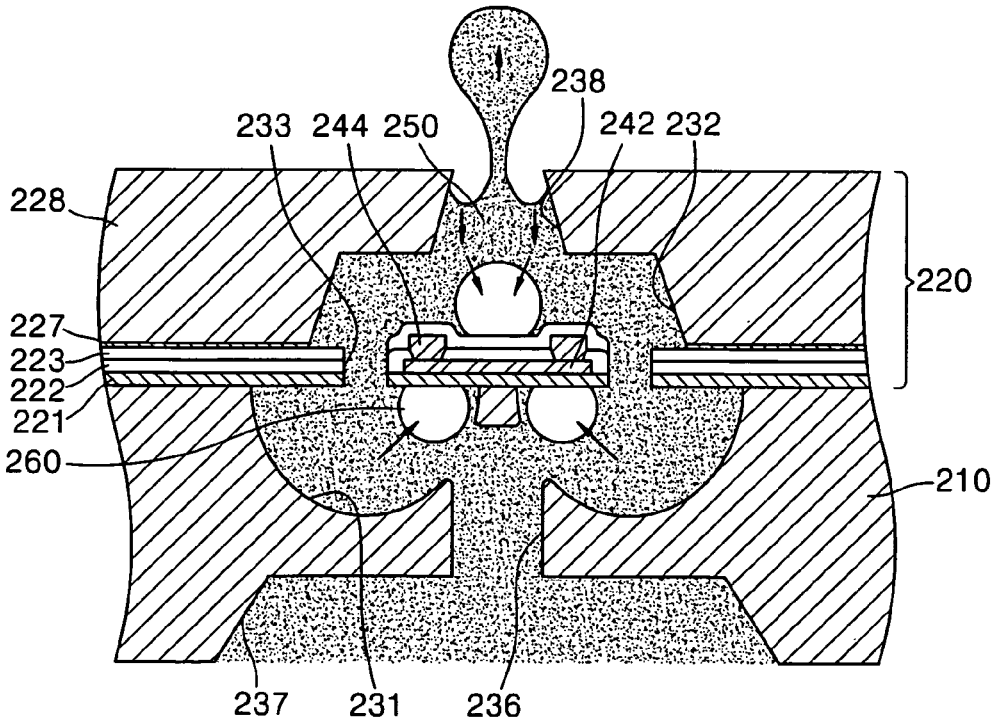

Referring to FIG. 6B, if the applied pulse current is interrupted when the bubble 260 expands to a maximum size thereof, the bubble 260 then shrinks until it collapses completely. At this time, a negative pressure is formed in the lower and upper ink chambers 231 and 232 so that the ink 250 within the nozzle 238 returns to the upper ink chamber 232. At the same time, a portion of the ink 250 being pushed out of the nozzle 238 is separated from the ink 250 within the nozzle 238 and ejected in the form of an ink droplet (250' of FIG. 6C) due to an inertial force.

A meniscus in the surface of the ink 250 formed within the nozzle 238 retreats toward the upper ink chamber 232 after the separation of the ink droplet 250'. In this arrangement, the nozzle 238 is sufficiently long due to the thick nozzle plate 220 so that the meniscus retreats only within the nozzle 238 and not into the upper ink chamber 232. Thus, this prevents air from flowing into the upper ink chamber 232 and quickly restores the meniscus to an original state, thereby stably maintaining high speed ejection of the ink droplet 250'. Further, since heat residing in or around the heater 242 after the separation of the ink droplet 250' passes through the metal layer 228 and is dissipated, the temperature in or around the heater 242 and the nozzle 238 drops even more rapidly.

Figure 6C:
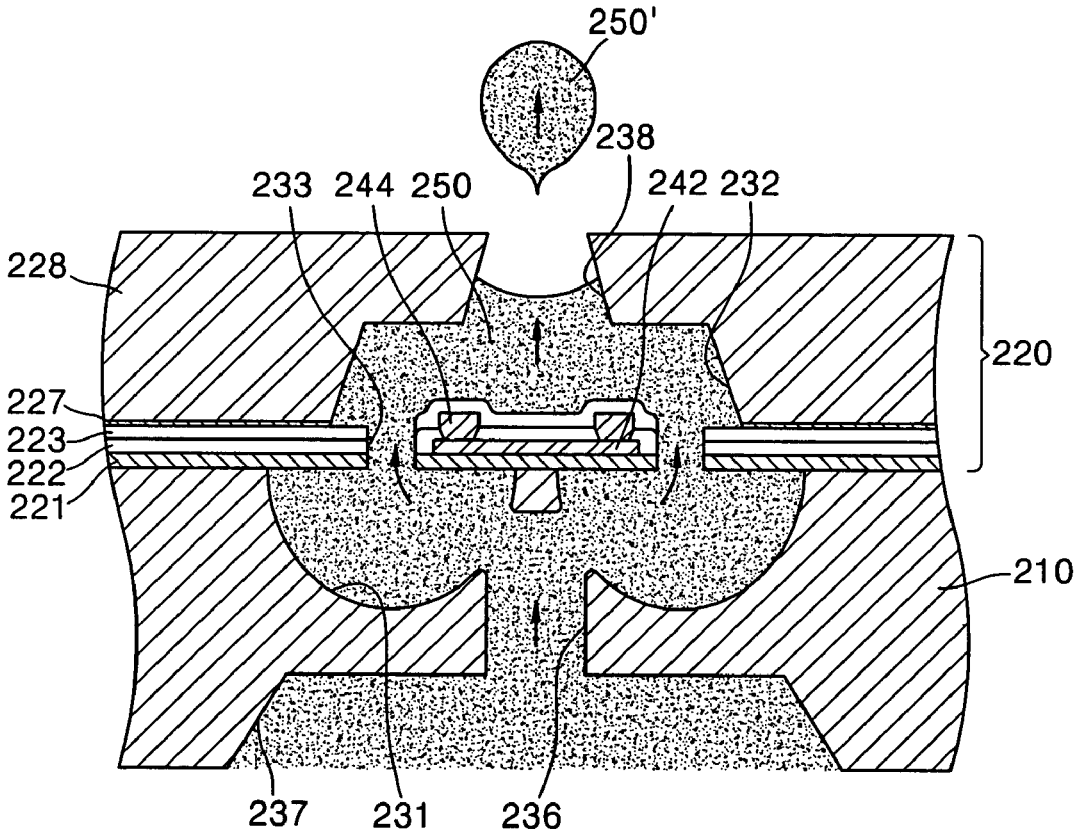

Next, referring to FIG. 6C, as the negative pressure within the lower and upper ink chambers 231 and 232 disappears, the ink 250 again flows toward the exit of the nozzle 238 due to a surface tension force acting at the meniscus formed in the nozzle 238. At this time, when the nozzle 238 has the tapered shape, the speed at which the ink 250 flows upward further increases. Accordingly, the lower and upper ink chambers 231 and 232 are again filled with the ink 250 supplied through the ink channel 236. When the refill of the ink 250 is completed so that the printhead returns to the initial state, the ink ejection mechanism is repeated. During the above process, the printhead can thermally recover the original state thereof more quickly because of heat dissipation through the metal layer 228.

A method for manufacturing a monolithic ink-jet printhead as presented above according to the preferred embodiment of the present invention, as shown in FIGS. 3A and 3B, will now be described.

FIGS. 7 through 18 illustrate cross-sectional views for explaining stages in a method for manufacturing a monolithic ink-jet printhead according to the preferred embodiment of the present invention shown in FIGS. 3A and 3B.

Figure 7:
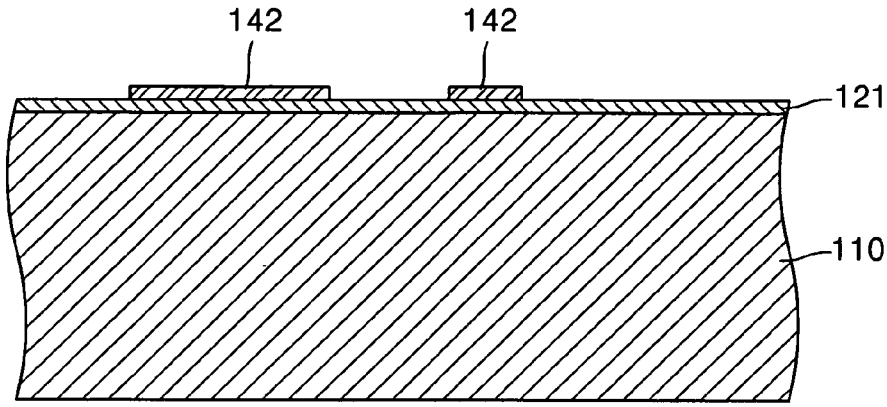
FIGS. 7 through 18 illustrate cross-sectional views for explaining stages in a method for manufacturing the monolithic ink-jet printhead according to the preferred embodiment of the present invention shown in FIGS. 3A and 3B.

Referring to FIG. 7, a silicon wafer used for the substrate 110 has been processed to have a thickness of approximately 300–500 μm. The silicon wafer is widely used for manufacturing semiconductor devices and is effective for mass production.

While FIG. 7 shows a very small portion of the silicon wafer, an ink-jet printhead according to the present invention can be manufactured in tens to hundreds of chips on a single wafer.

Initially, the first passivation layer 121 is formed on an upper surface of the prepared silicon substrate 110. The first passivation layer 121 may be formed by depositing silicon oxide or silicon nitride on the upper surface of the substrate 110.

Next, the heater 142 is formed on the first passivation layer 121 on the upper surface of the substrate 110. The heater 142 may be formed by depositing a resistive heating material, such as polysilicon doped with impurities, tantalum-aluminum alloy, tantalum nitride, titanium nitride, or tungsten silicide, on the entire surface of the first passivation layer 121 to a predetermined thickness and then patterning the same. Specifically, the polysilicon doped with impurities, such as a phosphorus (P)-containing source gas, may be deposited by low-pressure chemical vapor deposition (LPCVD) to a thickness of about 0.7–1 μm. Tantalum-aluminum alloy, tantalum nitride, titanium nitride, or tungsten silicide may be deposited by sputtering or chemical vapor deposition (CVD) to a thickness of about 0.1–0.3 μm. The deposition thickness of the resistive heating material may be determined in a range other than that given here to have an appropriate resistance considering the width and length of the heater 142. The resistive heating material is deposited on the entire surface of the first passivation layer 121 and then patterned by a photo process using a photomask and a photoresist and an etching process using a photoresist pattern as an etch mask.

Figure 8:
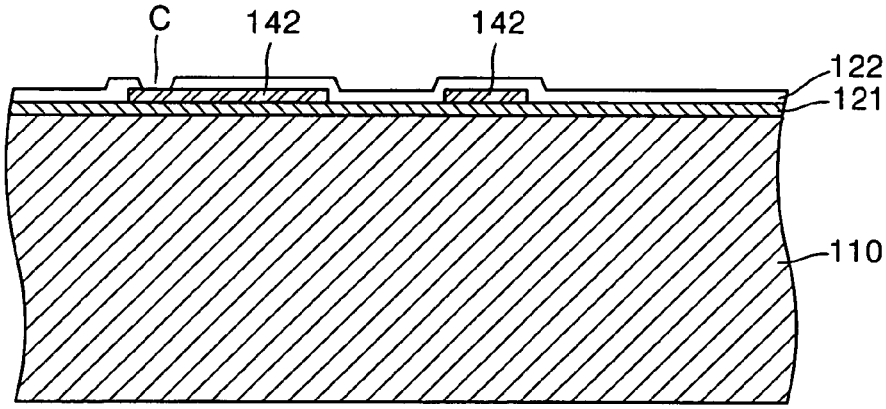

Subsequently, as shown in FIG. 8, the second passivation layer 122 is formed on the first passivation layer 121 and the heater 142 by depositing silicon oxide or silicon nitride to a thickness of about 0.5–3 μm. The second passivation layer 122 is then partially etched to form the contact hole C exposing a portion of the heater 142 to be connected with the conductor 144 in a subsequent step, which is shown in FIG. 9.

Figure 9:
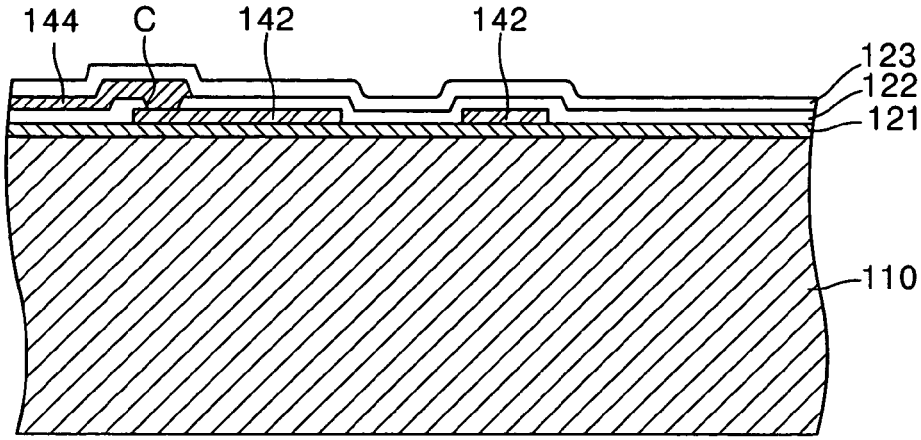

FIG. 9 illustrates the stage in which the conductor 144 and the third passivation layer 123 have been formed on the upper surface of the second passivation layer 122. Specifically, the conductor 144 can be formed by depositing a metal having excellent electric and thermal conductivity, such as aluminum, aluminum alloy, gold or silver, using a sputtering method to a thickness of about 1 μm and then patterning the same. Then, the conductor 144 is connected to the heater 142 through the contact hole C. Next, the third passivation layer 123 is formed on the second passivation layer 122 and the conductor 144. In detail, the third passivation layer 123 may be formed by depositing tetraethylorthosilicate (TEOS) oxide using plasma enhanced chemical vapor deposition (PECVD) to a thickness of approximately 0.7–3 μm.

Figure 10:
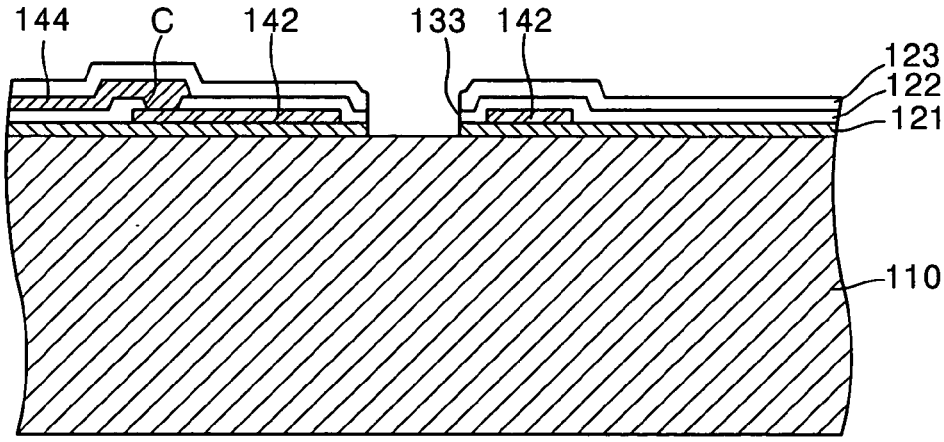

FIG. 10 illustrates the stage in which the connection hole 133 has been formed. The connection hole 133 is formed by sequentially anisotropically etching the third, second, and first passivation layers 123, 122, and 121 within the heater 142 using a reactive ion etching (RIE).

Figure 11:
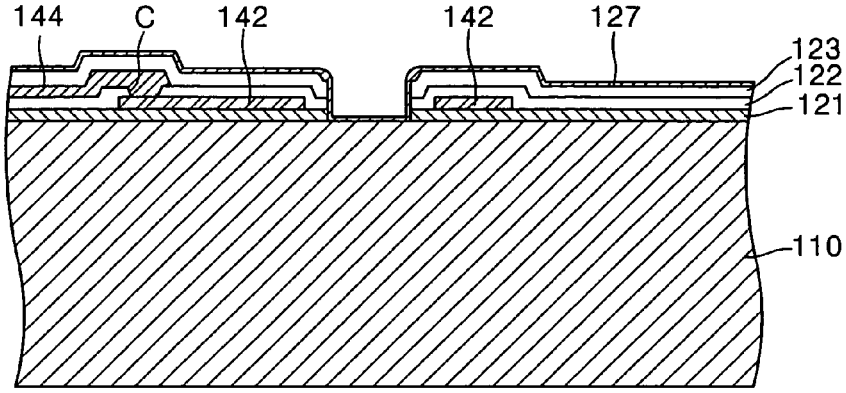

Next, as shown in FIG. 11, a seed layer 127 for electroplating is formed over the entire surface of the resultant structure of FIG. 10. To perform the electroplating, the seed layer 127 can be formed by depositing metal having good conductivity, such as titanium (Ti) or copper (Cu), to a thickness of approximately 500–3,000 Å by sputtering.

Figure 12:
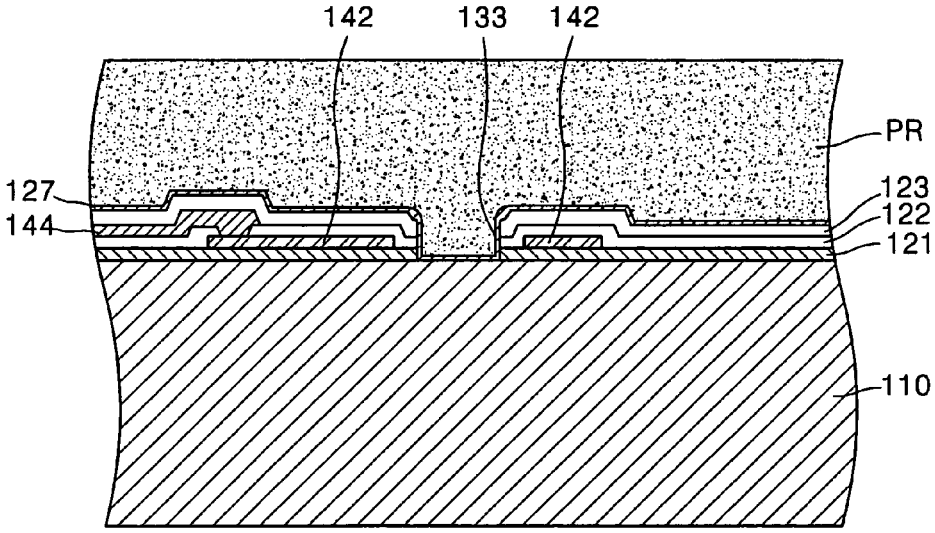
Figure 13:
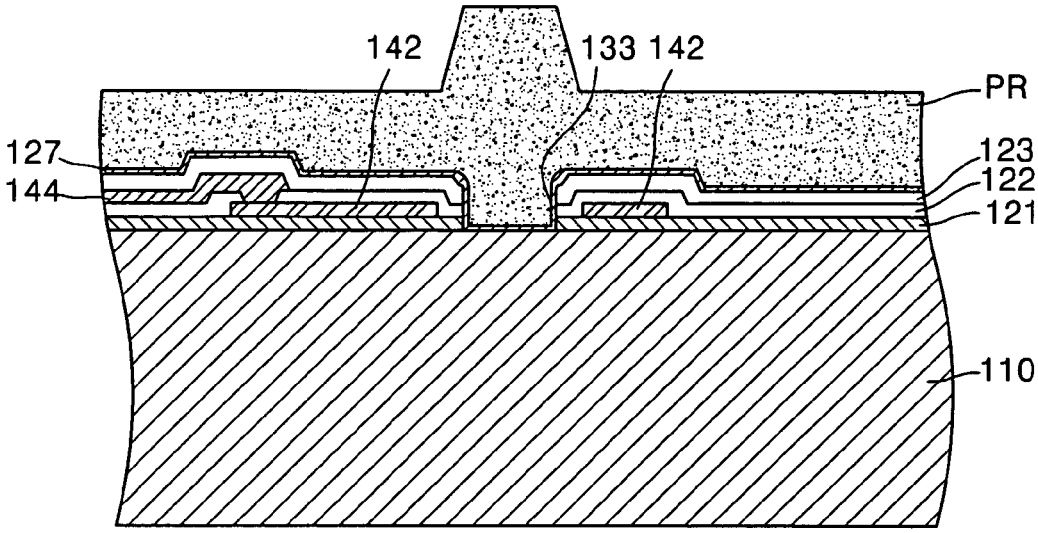
Figure 14:
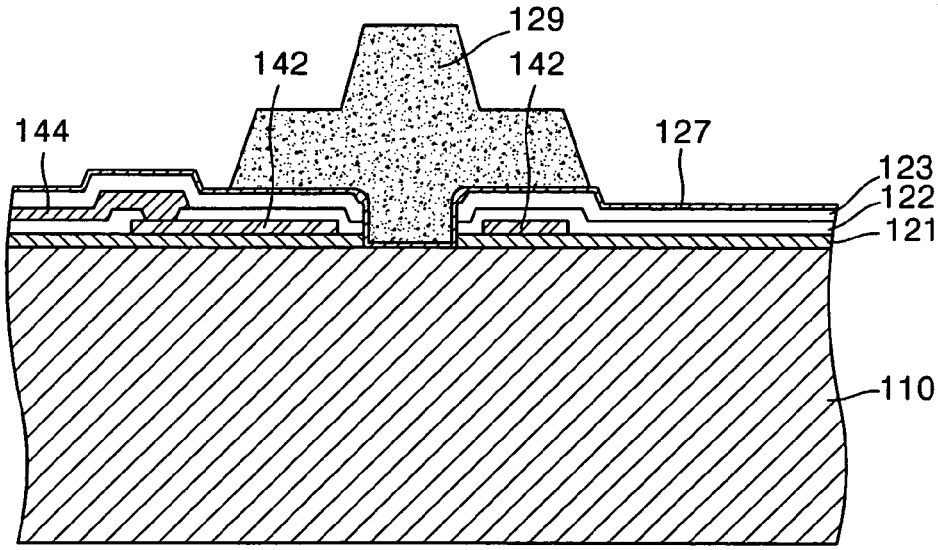

FIGS. 12 through 14 illustrate steps of forming a sacrificial layer 129 for forming an upper ink chamber and a nozzle.

As shown in FIG. 12, photoresist (PR) is first applied over the entire surface of the seed layer 127 to a thickness slightly greater than a height of the upper ink chamber and the nozzle. At this time, the photoresist fills the connection hole 133.

Next, as shown in FIG. 13, an upper portion of the photoresist is patterned so that photoresist only remains in a portion where the nozzle (138 of FIG. 16) will be formed. At this time, the photoresist is patterned in a tapered shape in which a cross-sectional area gradually increases downward. The patterning process can be performed by a proximity exposure process for exposing the photoresist PR using a photomask which is separated from an upper surface of the photoresist by a predetermined distance. In this case, light passed through the photomask is diffracted so that a boundary surface between an exposed area and a non-exposed area of the photoresist PR is inclined. An inclination of the boundary surface and the exposure depth can be adjusted by varying a distance between the photomask and the photoresist PR and by varying an exposure energy in the proximity exposure process.

Meanwhile, the nozzle 138 may be formed in a cylindrical shape, and in that case, the photoresist PR is patterned in a pillar shape.

Next, as shown in FIG. 14, the lower portion of the remaining photoresist PR is patterned so that photoresist only remains in a portion where the upper ink chamber (132 of FIG. 16) will be formed. At this time, the lower periphery of the remaining photoresist PR may be inclined or formed perpendicularly. In the former case, patterning can be performed by a proximity exposure process.

The sacrificial layer 129 for forming the upper ink chamber 132 and the nozzle 138 can be formed by patterning the photoresist PR in two steps as described above. Alternately, the sacrificial layer 129 can be formed of photosensitive polymer as well as the photoresist PR.

Figure 15:
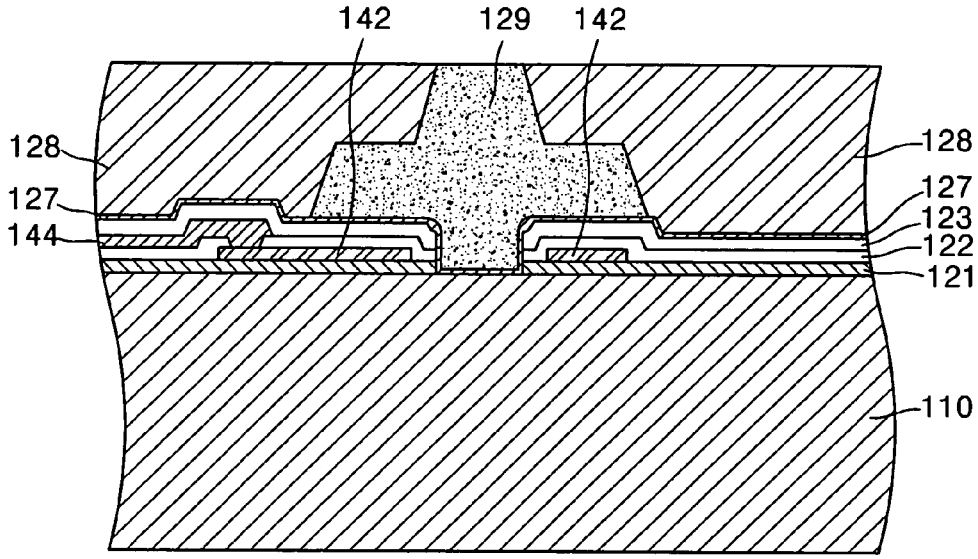

As shown in FIG. 15, the metal layer 128 is formed to a predetermined thickness on the upper surface of the seed layer 127. The metal layer 128 can be formed relatively thickly, that is, to a thickness of about 30–100 μm, preferably, 45 μm or more, by electroplating nickel (Ni), copper (Cu) or gold (Au). At this time, the thickness of the metal layer 128 can be appropriately determined in consideration of the heights of the upper ink chamber and the nozzle.

The electroplated metal layer 128 has irregularities on a surface thereof due to the underlying passivation layers. Thus, the surface of the metal layer 128 may be planarized by chemical mechanical polishing (CMP).

Figure 16:
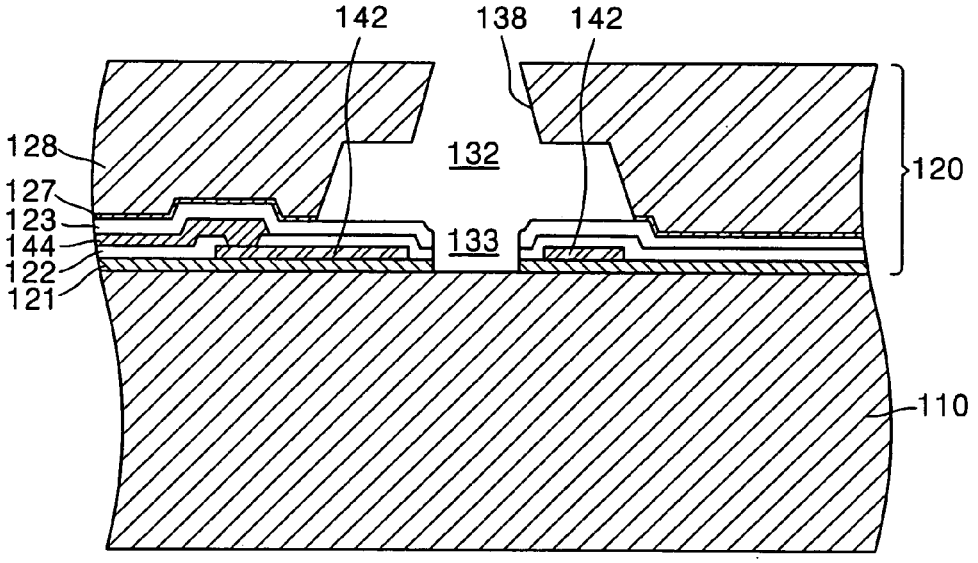

Next, the sacrificial layer 129 and the seed layer 127 underlying the sacrificial layer 129 are sequentially etched for removal. Then, as shown in FIG. 16, the upper ink chamber 132 and the nozzle 138 are formed and the connection hole 133 is formed in the passivation layers 121, 122 and 123. At the same time, the nozzle plate 120 comprised of a plurality of passivation layers stacked on the substrate 110 is completed.

In the alternative, a metal layer 128 having an upper ink chamber 132 and a nozzle 138 can be formed through the following steps. As shown in FIG. 12, a photoresist (PR) fills the connection hole 133 and is formed on the seed layer 127. Then, the sacrificial layer 129 is formed as described above. Next, as shown in FIG. 15, the metal layer 128 is formed and the surface thereof is then planarized by CMP. Subsequently, the sacrificial layer 129, the seed layer 127 underlying the sacrificial layer 129 and photoresist filling the connection hole 133 are sequentially etched for removal, thereby completing the nozzle plate 120 having the metal layer 128 shown in FIG. 16.

Figure 17:
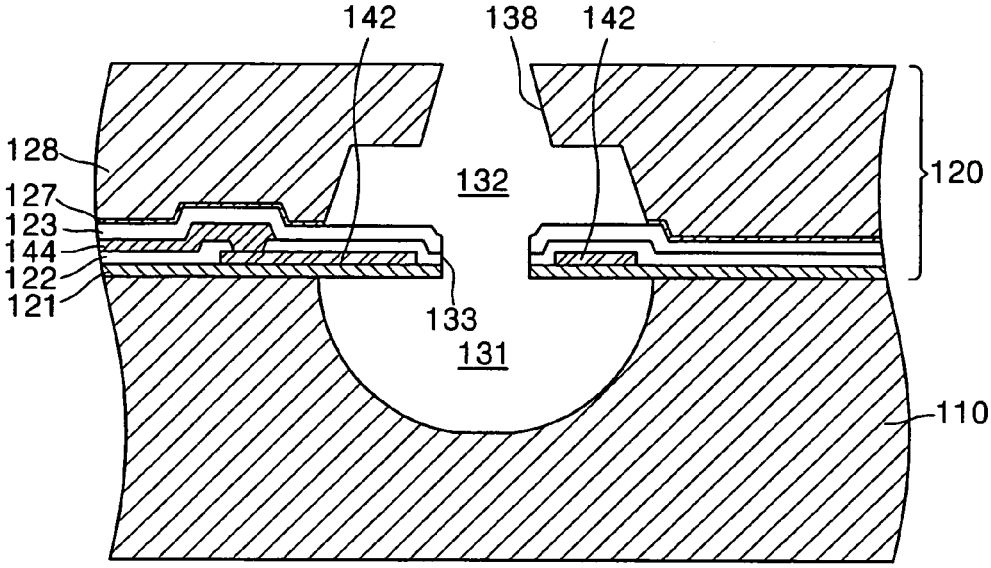

FIG. 17 illustrates the stage in which the lower ink chamber 131 of a predetermined depth has been formed on the upper surface of the substrate 110. The lower ink chamber 131 can be formed by isotropically etching the substrate 110 exposed through the connection hole 133. Specifically, dry etching is carried out on the substrate 110 using $XeF_2$ gas or $BrF_3$ gas as an etch gas for a predetermined time to form the hemispherical lower ink chamber 131 with a depth and a radius of about 20–40 μm as shown in FIG. 17.

Figure 18:
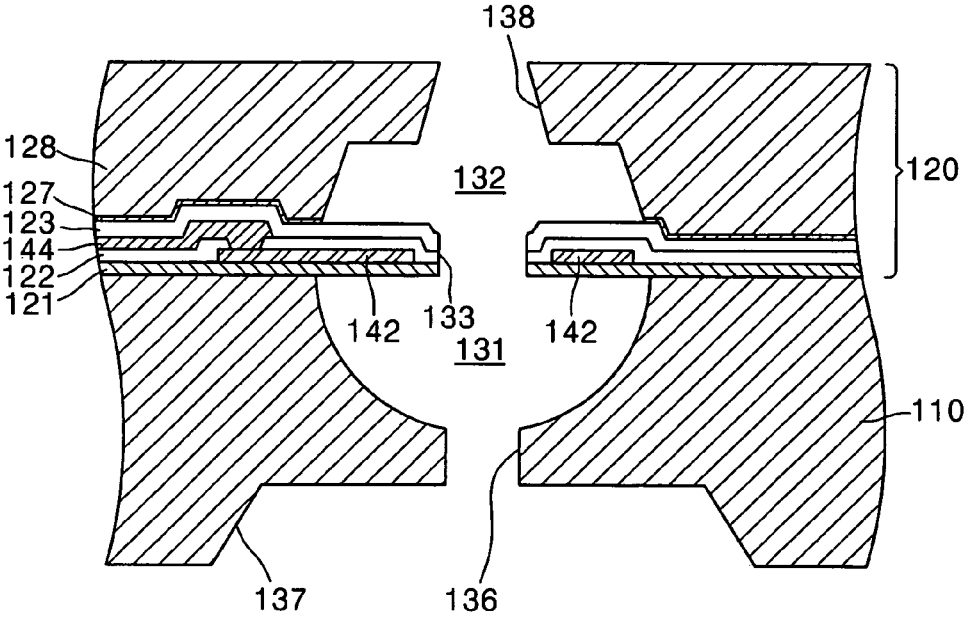

FIG. 18 illustrates the stage in which the manifold 137 and the ink channel 136 have been formed by etching the substrate 110 from the rear surface. Specifically, an etch mask that limits a region to be etched is formed on the rear surface of the substrate 110, and a wet etching on the rear surface of the substrate 110 is then performed using tetramethyl ammonium hydroxide (TMAH) or potassium hydroxide (KOH) as an etching solution to form the manifold 137 having an inclined side surface. Alternatively, the manifold 137 may be formed by anisotropically dry-etching the rear surface of the substrate 110. Subsequently, an etch mask that defines the ink channel 136 is formed on the rear surface of the substrate 110 where the manifold 137 has been formed, and the substrate 110 between the manifold 137 and the lower ink chamber 131 is then dry-etched by RIE, thereby forming the ink channel 136. Meanwhile, the ink channel 136 may be formed by etching the substrate 110 at the bottom of the lower ink chamber 131 through the nozzle 138 and the connection hole 133 from the upper surface of the substrate 110.

After having undergone the above steps, the monolithic ink-jet printhead according to the preferred embodiment of the present invention having the structure as shown in FIG. 18, in which the heater 142 is disposed between the lower ink chamber 131 formed on the substrate 110 and the upper ink chamber 132 formed on the metal layer 128 of the nozzle plate 120, is completed.

FIGS. 19 through 23 illustrate cross-sectional views for explaining stages in a method for manufacturing a monolithic ink-jet printhead according to the second embodiment of the present invention shown in FIGS. 4A and 4B. Hereinbelow, an explanation of the same elements as were described in connection with the preferred embodiment will be omitted or will be mentioned only briefly. In addition, since a method for manufacturing a monolithic ink-jet printhead according to a third embodiment of the present invention is similar to the method that will now be described, only a difference between the methods according to the second and third embodiments will be explained.

Figure 19:
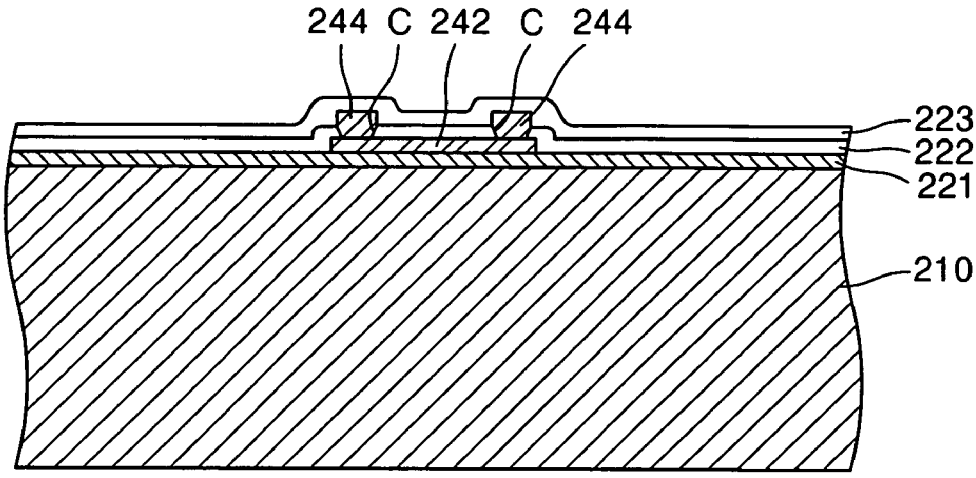
FIGS. 19 through 23 illustrate cross-sectional views for explaining stages in a method for manufacturing the monolithic ink-jet printhead according to the second embodiment of the present invention shown in FIGS. 4A and 4B.

Referring to FIG. 19, the first passivation layer 221 is formed on the silicon substrate 210 and the rectangular heater 242 is then formed on the first passivation layer 221.

Next, the second passivation layer 222 is formed on the first passivation layer 221 and the heater 242. The second passivation layer 222 is then partially etched to form the contact hole C exposing opposite ends of the heater 242, that is, portions to be connected to the conductor 244. Subsequently, the conductor 244 is formed on the second passivation layer 222 so as to be connected to the heater 242 through the contact hole C. The third passivation layer 223 is formed on the second passivation layer 221 and the conductor 244.

The steps shown in FIG. 19 are substantially the same as those in the above-described preferred embodiment except for the shape of the heater 242 and the arrangement type of the conductor 244, thus an explanation thereof will be omitted.

Figure 20:
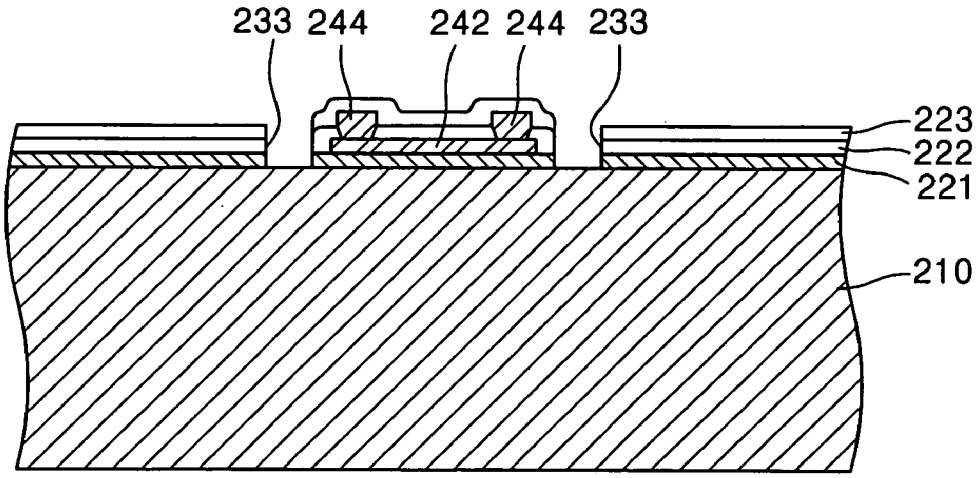

FIG. 20 illustrates a stage in which connection holes 233 have been formed. A plurality of connection holes 233 are provided around the heater 242 at an equal distance. In detail, the respective connection holes 233 may be formed by sequentially isotropically etching the third passivation layer 223, the second passivation layer 222 and the first passivation layer 221 by RIE.

In the case of forming the heater 342 shown in FIGS. 5A and 5B, in order to prevent the heater 342 and the connection holes 333 from overlying, apertures, such as a hole 342*a* completely surrounding each connection hole 333 and a groove 342*b* partially surrounding each connection hole 333 are pre-fabricated at locations where the connection holes 333 are to be formed, when patterning the heater 342.

Figure 21:
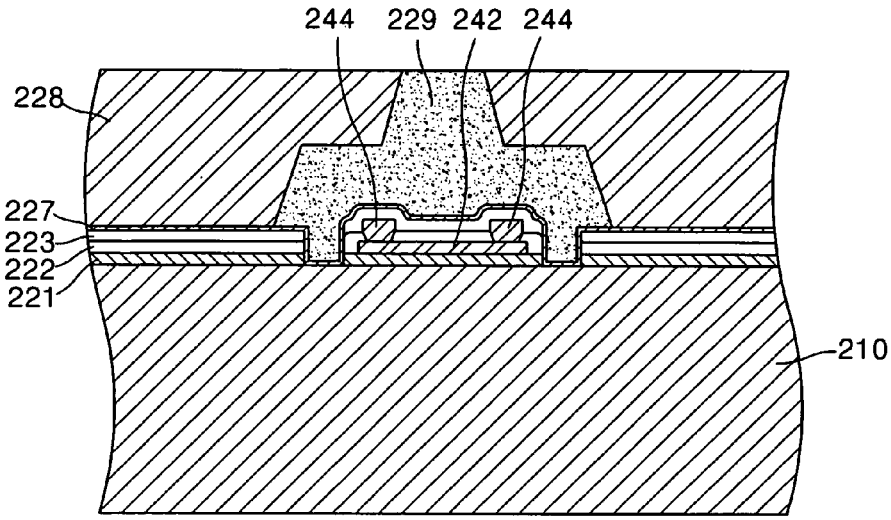

As shown in FIG. 21, the seed layer 227 for electroplating is formed on the entire surface of the resultant structure shown in FIG. 20. Subsequently, a photoresist is applied on the seed layer 227 to a predetermined thickness and patterned, thereby forming the sacrificial layer 229 for forming an upper ink chamber and a nozzle. Next, a metal having good thermal conductivity is electroplated on the seed layer 227 to form the metal layer 228. The surface of the metal layer 228 may be planarized by CMP. The methods of forming the seed layer 227, the sacrificial layer 229 and the metal layer 228 are the same as those described above, and a detailed explanation thereof will be omitted.

Figure 22:
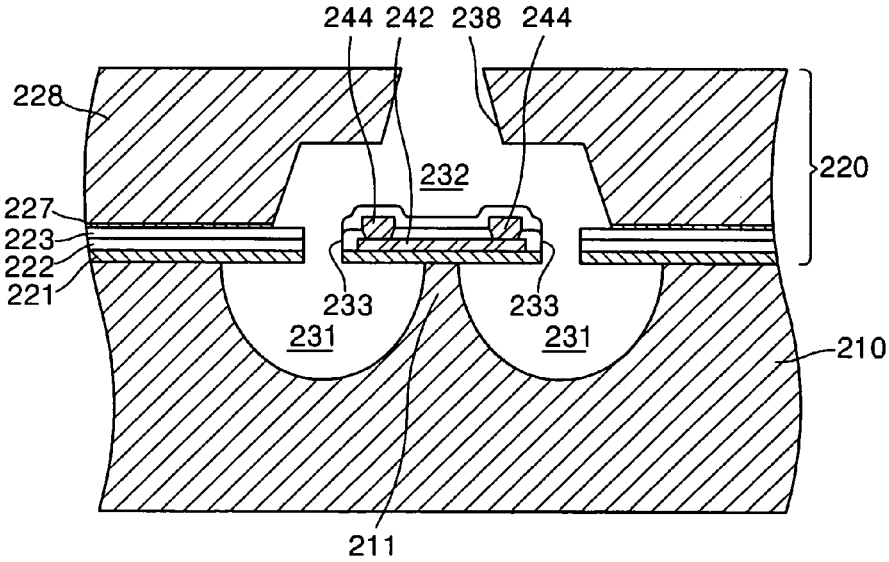

FIG. 22 illustrates a stage in which the nozzle 238, the upper ink chamber 232, the connection holes 233 and the lower ink chamber 231 have been formed. Specifically, the sacrificial layer 229 shown in FIG. 21 and the seed layer underlying the sacrificial layer 229 are sequentially etched for removal, thereby forming the upper ink chamber 232 and the nozzle 238 on the metal layer 228 and forming the connection holes 233 in the passivation layers 221, 222 and 223, as shown in FIG. 22. At the same time, the nozzle plate 220 comprised of a plurality of passivation layers stacked on the substrate 210 is completed.

Subsequently, the upper surface of the substrate 210 is isotropically etched to a predetermined depth through the plurality of connection holes 233. Specifically, dry etching is carried out on the substrate 210 using $XeF_2$ gas or $BrF_3$ gas as an etch gas for a predetermined time to form the hemispherical cavities under the connection holes 233. The hemispherical cavities are in communication in a circumferential direction, forming the lower ink chamber 231. In this case, the unetched substrate material 211 may remain under the central portion of the heater 242. However, the unetched substrate material 211 may be removed by reducing a spacing between each of the respective connection holes 233 or increasing an etching depth. Accordingly, the hemispherical cavities can be in communication in a radial direction as well as in the circumferential direction.

Figure 23:
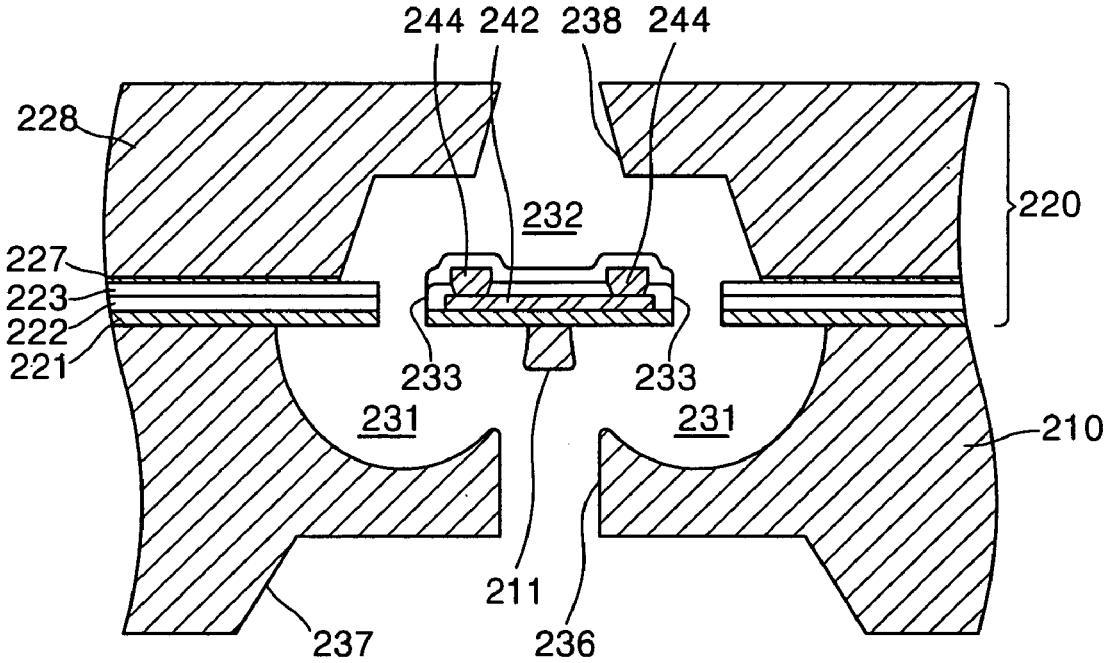

FIG. 23 shows a state in which the manifold 237 and the ink channel 236 have been formed by etching the rear surface of the substrate 210. The manifold 237 and the ink channel 236 are formed in the same manner as described above. The hemispherical cavities are in communication in a radial direction through the ink channel 236 by forming the ink channel 236 at the central portion of the lower ink chamber 231. Each one ink channel 236 may be formed at each of the hemispherical cavities forming the lower ink chamber 231.

After having undergone the above steps, the monolithic ink-jet printhead according to the second embodiment of the present invention having the structure as shown in FIG. 23 is completed.

As described above, a monolithic ink-jet printhead and a method for manufacturing the same according to the present invention have the following advantages.

First, since a heater is disposed between dual ink chambers, a majority of the heat energy generated from the heater can be transferred to ink contained in the ink chambers, increasing energy efficiency, thereby improving ink ejection performance.

Second, since heat residing in or around the heater after ink ejection is dissipated through a thick metal layer formed in a nozzle plate, an increase in the temperature of the printhead can be more effectively suppressed. Accordingly, the printhead can operate in a stable manner for an extended period of time.

Third, since the nozzle plate comprised of a plurality of passivation layers is integrally formed with the substrate, the manufacturing process can be simplified and the problem of misalignment between the ink chamber and the nozzle can be eliminated.

Preferred embodiments of the present invention have been disclosed herein and, although specific terms are employed, they are used and are to be interpreted in a generic and descriptive sense only and not for purpose of limitation. For example, materials used to form the constitutive elements of a printhead according to the present invention may not be limited to those described herein. In addition, the stacking and formation method for each material are only examples, and a variety of deposition and etching techniques may be adopted. Furthermore, specific numeric values illustrated in each step may vary within a range in which the manufactured printhead can operate normally. In addition, sequence of process steps in a method of manufacturing a printhead according to this invention may differ. Accordingly, it will be understood by those of ordinary skill in the art that various changes in form and details may be made without departing from the spirit and scope of the present invention as set forth in the following claims.

What is claimed is:

1. A monolithic ink-jet printhead, comprising:

a substrate having a lower ink chamber to be supplied with ink formed on an upper surface thereof, a manifold for supplying ink to the lower ink chamber formed on a bottom surface thereof, and an ink channel, which perpendicularly penetrates the substrate for providing communication between the lower ink chamber and the manifold;

a nozzle plate having a plurality of passivation layers stacked on the substrate and a metal layer stacked on the passivation layers, the nozzle plate having an upper ink chamber formed therein on a bottom surface of the metal layer, and a nozzle in communication with the upper ink chamber formed on an upper surface of the metal layer;

a heater provided between adjacent passivation layers of the plurality of passivation layers, the heater being located between the upper ink chamber and the lower ink chamber for heating ink contained in the lower and upper ink chambers;

a connection hole providing communication between the upper ink chamber and the lower ink chamber; and a conductor provided between adjacent passivation layers of the plurality of passivation layers, the conductor being electrically connected to the heater to apply a current to the heater.

2. The printhead as claimed in claim 1, wherein the upper ink chamber has a diameter the same as or smaller than a diameter of the lower ink chamber.

3. The printhead as claimed in claim 1, wherein the connection hole is formed at a location corresponding to a center of the upper ink chamber.

4. The printhead as claimed in claim 3, wherein the heater surrounds the connection hole.

5. The printhead as claimed in claim 1, wherein the connection hole may have a circular, oval or polygonal shape.

6. The printhead as claimed in claim 1, wherein the connection hole comprises a plurality of connection holes formed adjacent an edge of the upper ink chamber.

7. The printhead as claimed in claim 6, wherein the heater has a rectangular shape.

8. The printhead as claimed in claim 6, wherein the plurality of connection holes are formed around the heater and spaced apart a predetermined distance from the heater.

9. The printhead as claimed in claim 6, wherein at least a portion of each of the plurality of connection holes is disposed within the boundary of the heater, and the heater defines a plurality of apertures, each of the plurality of apertures exposing one of the plurality of connection holes.

10. The printhead as claimed in claim 9, wherein each of the plurality of apertures is either a hole surrounding an entire one of the plurality of connection holes or a groove surrounding a portion of one of the plurality of connection holes.

11. The printhead as claimed in claim 6, wherein the lower ink chamber includes a plurality of hemispherical cavities in communication in a circumferential direction below a respective one of the plurality of connection holes.

12. The printhead as claimed in claim 11, wherein the ink channel is formed at a central portion of a bottom of each of the plurality of hemispherical cavities.

13. The printhead as claimed in claim 1, wherein the ink channel comprises a single ink channel formed at a location corresponding to a center of the lower ink chamber.

14. The printhead as claimed in claim 1, wherein the ink channel comprises a plurality of ink channels formed on a bottom surface of the lower ink chamber.

15. The printhead as claimed in claim 1, wherein the nozzle has a tapered shape in which a cross-sectional area decreases gradually toward an exit.

16. The printhead as claimed in claim 1, wherein the metal layer is made of one selected from the group consisting of nickel, copper and gold.

17. The printhead as claimed in claim 1, wherein the metal layer is formed by electroplating to a thickness of about 30–100 μm.

18. A monolithic ink-jet printhead, comprising:

a substrate;

a nozzle plate, which is stacked on the substrate;

an ink chamber in which ink to be ejected is contained, the ink chamber including a lower ink chamber formed on the substrate and an upper ink chamber formed on the nozzle plate; an ink channel, which is formed on a bottom surface of the substrate to be connected to the lower ink chamber and supplies ink into the ink chamber;

a nozzle, which is formed on a top surface of the nozzle plate to be connected to the upper ink chamber and ejects the ink;

a heater, which is located between the lower ink chamber and the upper ink chamber to be positioned inside the ink chamber and heats the ink in the ink chamber to generate a bubble; and at least one connection hole, which connects the upper ink chamber to the lower ink chamber.

19. The monolithic ink-jet printhead as claimed in claim 18, wherein a plurality of passivation layers are stacked between the substrate and the nozzle plate, the heater is formed between adjacent passivation layers of the passivation layers, and the at least one connection hole passes through the passivation layers.

20. The monolithic ink-jet printhead as claimed in claim 18, wherein the connection hole is formed at a location corresponding to a center of the ink chamber, and the heater has a ring shape surrounding the connection hole.

21. The monolithic ink-jet printhead as claimed in claim 18, wherein the heater has a rectangular shape, and a plurality of connection holes are formed adjacent an edge of the heater.

22. A monolithic ink-jet printhead, comprising:

an ink chamber in which ink to be ejected is contained, the ink chamber including a lower ink chamber and an upper ink chamber in communication with each other;

an ink channel, which is connected to the lower ink chamber and supplies ink into the ink chamber;

a nozzle, which is connected to the upper ink chamber and ejects the ink;

a heater, which is located between the lower ink chamber and the upper ink chamber and heats the ink in the ink chamber to generate a bubble; and at least one connection hole, which connects the upper ink chamber to the lower ink chamber.

23. The monolithic ink-jet printhead as claimed in claim 22, wherein the connection hole is formed at a location corresponding to a center of the ink chamber, and the heater has a ring shape surrounding the connection hole.

24. The monolithic ink-jet printhead as claimed in claim 22, wherein the heater has a rectangular shape, and a plurality of connection holes are formed adjacent an edge of the heater.

* * * * *